US010995596B2

(12) United States Patent
Chen et al.

(10) Patent No.: US 10,995,596 B2
(45) Date of Patent: May 4, 2021

(54) SINGLE WELL CROSS STEAM AND GRAVITY DRAINAGE (SW-XSAGD)

(71) Applicant: ConocoPhillips Company, Houston, TX (US)

(72) Inventors: Qing Chen, Houston, TX (US); Wendell P. Menard, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 15/363,403

(22) Filed: Nov. 29, 2016

(65) Prior Publication Data

US 2018/0135392 A1 May 17, 2018

Related U.S. Application Data

(60) Provisional application No. 62/261,576, filed on Dec. 1, 2015.

(51) Int. Cl.

| | |
|---|---|
| ***E21B 43/14*** | (2006.01) |
| ***E21B 33/12*** | (2006.01) |
| ***E21B 43/24*** | (2006.01) |
| ***E21B 43/30*** | (2006.01) |

(52) U.S. Cl.

CPC ..... *E21B 43/2406* (2013.01); *E21B 33/12* (2013.01); *E21B 43/14* (2013.01); *E21B 43/305* (2013.01)

(58) Field of Classification Search

None

See application file for complete search history.

(56) References Cited

U.S. PATENT DOCUMENTS

| | | | | |
|---|---|---|---|---|
| 4,565,245 | A | 1/1986 | Mims et al. | |
| 5,626,193 | A | 5/1997 | Nzekwu et al. | |
| 6,257,334 | B1 * | 7/2001 | Cyr | E21B 43/2406 166/263 |
| 8,240,381 | B2 | 8/2012 | Menard et al. | |
| 8,528,638 | B2 | 9/2013 | Dong | |
| 8,528,639 | B2 | 9/2013 | Fang et al. | |
| 8,607,866 | B2 | 12/2013 | Fang et al. | |
| 8,607,867 | B2 | 12/2013 | Sarathi et al. | |
| 8,967,282 | B2 | 3/2015 | Dreher, Jr. et al. | |
| 2010/0326656 | A1 | 12/2010 | Menard | |
| 2012/0043081 | A1 | 2/2012 | Kjorholt | |

(Continued)

FOREIGN PATENT DOCUMENTS

| | | |
|---|---|---|
| CA | 2854751 | 5/2014 |
| CN | 204386576 | 6/2015 |
| WO | 2013075208 | 5/2013 |
| WO | 2015000065 | 1/2015 |

OTHER PUBLICATIONS

Falk, K., et al., "Concentric CT for Single-Well Steam Assisted Gravity Drainage," World Oil, Jul. 1996, pp. 85-95.

(Continued)

*Primary Examiner* — Charles R Nold

(74) *Attorney, Agent, or Firm* — Boulware & Valoir

(57) ABSTRACT

The present disclosure relates to a particularly effective well configuration that can be used for single well cross steam assisted gravity drainage (SW-XSAGD) wherein a single well has multiple injection sections each separated by a production segment that is completed with passive FCDs to control steam flashing.

17 Claims, 6 Drawing Sheets

(56) References Cited

U.S. PATENT DOCUMENTS

| | | | | |
|---|---|---|---|---|
| 2012/0247760 | A1 | 10/2012 | Wheeler et al. | |
| 2012/0273195 | A1 | 11/2012 | Wheeler et al. | |
| 2013/0180712 | A1 | 7/2013 | Nasr et al. | |
| 2013/0213652 | A1 | 8/2013 | Stalder | |
| 2013/0213653 | A1 | 8/2013 | Stalder | |
| 2013/0333885 | A1 | 12/2013 | Carrizales et al. | |
| 2014/0000888 | A1 | 1/2014 | Kerr | |
| 2014/0345855 | A1 | 11/2014 | Wilfing et al. | |
| 2014/0345861 | A1 | 11/2014 | Stalder et al. | |
| 2015/0053419 | A1 | 2/2015 | Garcia et al. | |
| 2015/0107842 | A1* | 4/2015 | Sood | E21B 43/2406 166/306 |

OTHER PUBLICATIONS

Moreira, R.D.R., et al., Improving SW-SAGD (Single Well Steam Assisted Gravity Drainage), Proceedings of COBEM 2007 19th International Congress of Mechanical Engineering, available online at http://www.abcm.org.br/pt/wp-content/anais/cobem/2007/pdf/COBEM2007-0646.pdf.

Ashok, K. et al., A Mechanistic Study of Single Well Steam Assisted Gravity Drainage. SPE-59333 (2000).

Stalder, J.L., Cross SAGD (XSAGD)—an accelerated bitumen recovery alternative, SPE Reservoir Evaluation & Engineering 10(1), 12-18, SPE-9764T-PA (2007).

Elliot, K., Simulation of early-time response of singlewell steam assisted gravity drainage (SW-SAGD), SPE-54618 (1999).

Stalder, J., Test of SAGD Flow Distribution Control Liner System, Surmont Field, Alberta, Canada, SPE 153706, Mar. 2012.

McCormack, M., "Hydraulic Design of Thermal Horizontal Wells," presented at Canadian Section SPE/48th Annual Technical Meeting of The Petroleum Society in Calgary, Alberta, Canada, Jun. 8-11, 1997, Paper 97-11.

Shen, O., "Numerical Investigation of SAGD Process Using a Single Horizontal Well," SPE 50412, Nov. 1998.

International Search Report for related case, App. No. PCT/US2016/064004, dated Jan. 30, 2017.

* cited by examiner

SINGLE WELL CROSS STEAM AND GRAVITY DRAINAGE (SW-XSAGD)

CROSS-REFERENCE TO RELATED APPLICATIONS

This application is a non-provisional application which claims benefit under 35 USC § 119(e) to U.S. Provisional Application Ser. No. 62/261,576 filed Dec. 1, 2015, entitled "SINGLE WELL CROSS STEAM AND GRAVITY DRAINAGE (SW-XSAGD)," which is incorporated herein in its entirety.

STATEMENT REGARDING FEDERALLY SPONSORED RESEARCH

Not Applicable.

FIELD OF THE INVENTION

This disclosure relates generally to methods that can advantageously produce oil using steam-based mobilizing techniques. In particular, it relates to improved single well cross gravity drainage techniques with better production rates than previously available and with half the well count.

BACKGROUND OF THE INVENTION

Oil sands are a type of unconventional petroleum deposit, containing naturally occurring mixtures of sand, clay, water, and a dense and extremely viscous form of petroleum technically referred to as "bitumen," but which may also be called heavy oil or tar. Bitumen is so heavy and viscous that it will not flow unless heated and/or diluted with lighter hydrocarbons. At room temperature, bitumen is much like cold molasses, and the viscosity can be in excess of 1,000,000 cP in the field.

Due to their high viscosity, these heavy oils are hard to mobilize, and they generally must be heated in order to produce and transport them. One common way to heat bitumen is by injecting steam into the reservoir. Steam Assisted Gravity Drainage or "SAGD" is the most extensively used technique for in situ recovery of bitumen resources in the McMurray Formation in the Alberta Oil Sands.

In a typical SAGD process, two horizontal wells are vertically spaced by 4 to 10 meters (m). See FIG. 1. The production well is located near the bottom of the pay and the steam injection well is located directly above and parallel to the production well. Steam is injected continuously into the injection well, where it rises in the reservoir and forms a steam chamber. With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

The use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Although quite successful, SAGD does require large amounts of water in order to generate a barrel of oil. Some estimates provide that 1 barrel of oil from the Athabasca oil sands requires on average 2 to 3 barrels of water, and it can be much higher, although with recycling the total amount can be reduced. In addition to using a precious resource, additional costs are added to convert those barrels of water to high quality steam for down-hole injection. Therefore, any technology that can reduce water or steam consumption has the potential to have significant positive environmental and cost impacts.

Additionally, SAGD is less useful in thin stacked payzones, because thin layers of impermeable rock in the reservoir can block the expansion of the steam chamber leaving only thin zones accessible, thus leaving the oil in other layers behind. Further, the wells need a vertical separation of about 4-5 meters in order to maintain the steam trap. In wells that are closer, live steam can break through to the producer well, resulting in enlarged slots that permit significant sand entry, well shutdown and expensive damage to equipment.

Indeed, in a paper by Shin & Polikar (2005), the authors simulated reservoir conditions to determine which reservoirs could be economically exploited. The simulation results showed that for Cold Lake-type reservoirs, a net pay thickness of at least 20 meters was required for an economic SAGD implementation. A net pay thickness of 15 m was still economic for the shallow Athabasca-type reservoirs because of the high permeability of this type of reservoir, despite the very high bitumen viscosity at reservoir conditions. In Peace River-type reservoirs, net pay thicker than 30 meters was expected to be required for a successful SAGD performance due to the low permeability of this type of reservoir. The results of the study indicate that the shallow Athabasca-type reservoir, which is thick with high permeability (high k×h), is a good candidate for SAGD application, whereas Cold Lake and Peace River-type reservoirs, which are thin with low permeability, are not as good candidates for conventional SAGD implementation.

In order to address the thin payzone issue, some petroleum engineers have proposed a single wellbore steam assisted gravity drainage or "SW-SAGD." See e.g., FIG. 2A. In SW-SAGD, a horizontal well is completed and assumes the role of both injector and producer. In a typical case, steam is injected at the toe of the well, while hot reservoir fluids are produced at the heel of the well, and a thermal packer is used to isolate steam injection from fluid production (FIG. 2A).

Another version of SW-SAGD uses no packers, simply tubing to segregate flow. Steam is injected at the end of the horizontal well (toe) through an insulated concentric coiled tubing (ICCT) with numerous orifices. In FIG. 2B a portion of the injected steam and the condensed hot water returns through the annular to the well's vertical section (heel). The remaining steam, grows vertically, forming a chamber that expands toward the heel, heating the oil, lowering its viscosity and draining it down the well's annular space by gravity, where it is pumped up to the surface through a second tubing string.

Advantages of SW-SAGD can include cost savings in drilling and completion and utility in relatively thin reservoirs where it is not possible to drill two vertically spaced horizontal wells. Basically, since there is only one well, instead of a well pair, drilling costs are only half that of conventional SAGD. However, the process is technically challenging and the method seems to require even more steam than conventional SAGD.

Field tests of SW-SAGD are not extensively documented in the literature, but the available evidence suggests that there is room to optimize the SW-SAGD process.

For example, Falk overviewed the completion strategy and some typical results for a project in the Cactus Lake Field, Alberta Canada. A roughly 850 meter (m) long well was installed in a region with 12 to 16 m of net pay to produce 12° API gravity oil. The reservoir contained clean, unconsolidated, sand with 3400 and permeability. Apparently, no attempts were made to preheat the reservoir before initiation of SW-SAGD. Steam was injected at the toe of the well and oil produced at the heel. Oil production response to steam was slow, but gradually increased to more than 100 $m^3$/d. The cumulative steam-oil ratio was between 1 and 1.5 for the roughly 6 months of reported data.

McCormack also described operating experience with nineteen SW-SAGD installations. Performance for approximately two years of production was mixed. Of their seven pilot projects, five were either suspended or converted to other production techniques because of poor production. Positive results were seen in fields with relatively high reservoir pressure, relatively low oil viscosity, significant primary production by heavy-oil solution gas drive, and/or insignificant bottom-water drive. Poor results were seen in fields with high initial oil viscosity, strong bottom-water drive, and/or sand production problems. Although the authors noted that the production mechanism was not clearly understood, they suspected that the mechanism was a mixture of gravity drainage, increased primary recovery because of near-wellbore heating via conduction, and hot water induced drive/drainage.

Moriera et al., (2007) simulated SW-SAGD using CMG-STARS, attempting to improve the method by adding a pre-heating phase to accelerate the entrance of steam into the formation, before beginning the SW-SAGD process. Two processes were modeled, as well as SW-SAGD and SAGD with conventional well pairs. The improved processes tested were 1) Cyclic injection-soaking-production repeated three times (20, 10 and 30 days for injection, soaking and production respectively), and 2) Cyclic injection repeated three times as in 1), but with the well divided into two portions by a packer, where preheat occurred throughout the well, but production occurring only in the producing half.

Moriera et al., found that the cyclical preheat period provided better heat distribution in the reservoir and reduced the required injection pressure, although it increased the waiting time for the continuous injection process. Additionally, the division of the well by a packer and the injection of the steam in two points during preheat, in the middle and at the extremity of the well, helped the distribution of heat in the formation and favored oil recovery in the cyclical injection phase. They also found that in the continuous injection phase, the division of the well induced an increase of the volume of the steam chamber, and improved the oil recovery in relation to the original SW-SAGD process. Also, an increase of the blind interval (blank pipe), between the injection and production passages, increased the pressure differential and drove the displaced oil in the injection section into the production area, but caused some imprisonment of the oil in the injection section, reducing the recovery factor.

Overall, the authors concluded that modifications in SW-SAGD operation strategies can lead to better recovery factors and oil steam ratios than those obtained with the conventional SAGD process using well pairs, but that SW-SAGD performance was highly variable, suggesting there is room for additional improvement.

Yet another variation on SAGD is cross-SAGD or XSAGD. The basic concept is to place the steam injection wells perpendicular to the producing wells (e.g., FIG. 3A) and to use some form of completion restriction or flow distribution control completion technique to limit short-circuiting of steam near the crossing points. Stalder's simulation comparison of SAGD and XSAGD showed accelerated recovery and higher thermal efficiency in XSAGD (Stalder 2007). He also pointed out two penalties with the XSAGD concept. First, in the early stage, only portions of wells near cross points were effective for steam chamber growth, therefore giving a limited initial production rate. Second, the complex plugging operation required additional cost and posed a serious practical challenge to operations.

Further, the pilot tests for the XSAGD concept have not yet been done because a multiple well pilot would be required to demonstrate the effective management of drainage across the grid and this concept does not easily "fit" into a classical SAGD setting. In other words, if the concept fails it would be expensive to convert the test region into a classical SAGD development by having to drill a full set of wells parallel to one set of wells to replace the perpendicular wells.

The conventional SW-SAGD utilizes one single horizontal well to inject steam into reservoir through toe and produce liquid (oil and water) through mid and heel of the well, as schematically shown in FIGS. 2A and B. A steam chamber is expected to form and grow from the toe of the well. Similar to the SAGD process, the oil outside of the steam chamber is heated up with the latent heat of steam, becomes mobile, and drains with steam condensate under gravity towards the production portion of the well. With continuous steam injection through toe and liquid production through the rest of the well, the steam chamber expands gradually towards to the heel to extract oil.

Due to the unique arrangement of injection and production, the SW-SAGD can also benefit from pressure drive in addition to gravity drainage as the recovery mechanisms. Also, compared with its counterpart, the traditional "SAGD" configuration with a conventional well pair, SW-SAGD requires only one well, thereby saving almost half of well cost. SW-SAGD becomes particularly attractive for thin-zone applications where placing two horizontal wells with the typical 4-10 m vertical separation required in the SAGD is technically and economically challenging.

SW-SAGD, however, has some disadvantages.

First of all, SW-SAGD is not efficient in developing the steam chamber. The steam chamber growth depends largely upon the thermal conduction to transfer steam latent heat into cold reservoir and oil drainage under gravity along the chamber interface. Due to the arrangement of injection and production points in the conventional SW-SAGD, the steam chamber can grow only direction towards the heel. In other words, only one half of the surface area surrounding the steam chamber is available for heating and draining oil.

Secondly, a large portion of the horizontal well length perforated for production does not actually contribute to oil production until the steam chamber expands over the whole length. This is particularly true during the early stage where only a small portion of the well close to the toe collects oil, reducing early production rates compared with SW-SAGD.

In conventional SAGD, the injector is placed approximately 5 meters above the producer, which provides has a distinct advantage during the early portion of the process of establishing the steam chamber. However, this close spacing poses a challenge to avoid short-circuiting of the steam from the injector directly into the producer later on.

Once a steam chamber has been established, it would be beneficial to move the injection and production wells farther apart, possibly both vertically and laterally, to improve steam-trap control at higher production rates. XSAGD essentially was an attempt to move the points of injection and production farther apart at a strategic time to improve performance.

The concept was to drill the injection wells above the production wells with spacing similar to that used in SAGD, but unlike SAGD, the injectors were placed perpendicular to the producers. Portions of the wells near the crossing points were plugged after a period of steam injection, or the completion design may restricted flow near these crossing points from the start. The plugging operation or restricted completion design effectively blocks or throttles the short circuit between wells at the crossing points, with the effect of moving the points of injection and production apart laterally. See FIG. 3B.

The increased lateral distance between the injecting and producing segments of the wells improved the steam-trap control because steam vapor tends to override the denser liquid phase as injected fluids move laterally away from the injector. This allowed production rates to be increased while avoiding live steam production.

With this unique well arrangement and flexibility to manage the distance between injection and production segments of wells, XSAGD was expected to achieve a significant rate and thermal efficiency advantage over SAGD, and the potential performance improvement over SAGD was shown by simulation (Stalder, 2007).

However, no pilot test of XSAGD was performed, because it cannot be down-scaled to a few test wells. The other limitations of XSAGD include the initial steam chamber development occurs only at the cross points, the complex well completion and consequent additional costs, and being inapplicable to thin zone development. Completions that are restricted at the crossing points from the beginning may avoid the risks and costs of later plugging, but such completions will allow limited short-circuiting of the injected steam throughout the life of the process with some impact on thermal efficiency.

Thus, although beneficial, the SW-SAGD and XSAGD methodologies could be developed to further improve cost effectiveness. This application addresses some of those needed improvements.

BRIEF SUMMARY OF THE INVENTION

The original XSAGD process provides flexibility to manage the distance between the points of injection and production, and may result in better performance than SAGD by drilling injection wells above production wells with spacing similar to that used in SAGD, but with the injectors oriented perpendicular to the producers. However, XSAGD requires many wells forming a "checkerboard" grid, and there has been no field trial of XSAGD to evaluate its performance due to the high cost. Also, XSAGD is not applicable to thin zone (10-15 m pay) due to vertical space limitations.

The conventional SW-SAGD utilizing one single horizontal well to inject steam into reservoir through toe and produce liquid (oil and water) through the middle and heel of the well has potential application in thin-zone applications where placing two horizontal wells with 5 m vertically apart required in the SAGD is technically and economically challenging. SW-SAGD, however, exhibits several disadvantages due to slow steam chamber growth and initial low oil production rate.

First of all, SW-SAGD is not efficient in developing the steam chamber. Due to the arrangement of injection and production points in the conventional SW-SAGD, the steam chamber can grow only in one side towards the heel. In other words, only one half of the surface area surrounding the steam chamber is available for heating and draining oil.

Secondly, a large portion of the horizontal well length perforated for production does not actually contribute to oil production until the steam chamber expands over the whole length. This is particularly true during the early stage where only a small portion of the well close to the toe collects oil. Thus, initial production rates are low.

This disclosure proposes instead to use multiple steam injection points to improve steam chamber development and recovery performance, coupled with FCD completions in the production zones to control steam breakthrough. The essential idea to use single-well SAGD with multiple steam injection points and inflow control devices within the production segments of the well is implemented to replace the crossing wells in the original XSAGD and achieve the similar improved steam chamber development as in the original XSAGD.

FIG. 4 gives a schematic of single-well XSAGD. In single-well XSAGD, multiple horizontal wells are drilled from the well pad and placed close to the bottom of the pay zone. Those horizontal wells are (roughly) parallel to each other, with lateral spacing similar to SAGD well pairs, i.e., 75 m to 150 m. Note that, unlike SAGD or XSAGD, there is no need of any upper injectors.

As an alternative, the wells can be in a radial pattern, emanating from the same well pad, and laterals can be used to bridge the gaps as distance from the well pad increases. Combination of these two basic patterns are also possible.

Those horizontal wells are completed with multiple steam injection segments (e.g., 1 to 50 m each) and production segments (e.g., 150 to 200 m each) that are alternated and evenly distributed along the wells. Thermal packers are required to separate the injection and production segments within the same wells. For the production segments, passive flow control devices are installed to actively control steam/gas break-through.

The operation of the SW-XSAGD is straightforward. Depending upon initial reservoir conditions, the SW-XSAGD process can start directly with steam injection if there is initial injectivity, or with a preheating period (e.g., 3-6 months), in which steam is circulated throughout wellbore to heat up the near well region and establish thermal and fluid communications between the injection and production segments. After startup, steam is continuously injected at the multiple injection points only through the injection segments in each well.

The multiple steam chambers form simultaneously along each well at each injection segment will eventually merge. Just like in the SAGD, the oil surrounding the steam chambers is heated up and drains towards to the production segments under gravity when it becomes mobile.

The FCDs installed within the production segments become important when the steam chambers develop over the production portions of the well. Without inflow control devices, the liquid production rate has to be constrained to avoid live steam production, and the resulting well damage that occurs when steam breaks through. However, with FCDs, the steam/gas breakthrough automatically results in large pressure drop across the FCD, thereby causing block of gas production locally and allowing higher liquid withdraw rate through the rest of production the segment and better overall thermal efficiency. The FCDs thus function similar to the manual plug control in the original XSAGD—both allow managing the distance between the injection and production points through the life of the process.

During the later stages of the operation, the steam chambers mature with oil depleted from most of the reservoir, but there may be still some oil left behind to the extent that there are untapped wedges between steam chambers. The process can then be converted into steam flood by converting alternating wells into pure injectors and producers, respectively, targeting the wedge oil zones and driving oil towards production wells until the economic limit is reached.

The proposed concept of single-well XSAGD exhibits several advantages over the original XSAGD. First of all, the single-well XSAGD is down-scalable and can be implemented with one or a few standalone wells. This becomes important for piloting the technology to demonstrate its feasibility and performance prior to commercialization.

Second, the single-well XSAGD does not need drilling of upper injectors as required in SAGD and the original XSAGD. Even though the single-well XSAGD requires a complex well completion and consequently additional cost per well, the saving of reducing the number of wells by half is expected to offset the additional well cost due to the complex well completion. Further, without the need of crossing wells, the single-well XSAGD allows more flexible layout that can be easily tailored to the development of drainage areas with irregular areal distribution.

Additionally, the single-well XSAGD is applicable to thin zones due to the single-well configuration and may present a potential game changer for development of vast thin zone resources that are not economically recoverable with current technologies in western Canada and elsewhere.

The method can include a preheat or cyclic preheat startup phase if desired. In preheat, steam is injected and allow to soak, thus preheating the reservoir, improving steam chamber development and injectivity. In cyclic preheat, steam is injected throughout both injector and producer segments, for e.g. 20-50 days, then allowed to soak into the reservoir, e.g., for 10-30 days, and any oil recovered. This preheat cycle is then repeated two or preferably three times. However, with the method of the invention, the preheat time is expected to be substantially reduced, and possibly a single preheat or shorter preheat cycles may suffice and preheat may even be eliminated.

Also the steam injection can be combined with solvent injection or non-condensable gas injection, such as $CO_2$, as solvent dilution and gas lift can assist in recovery.

The invention can comprise any one or more of the following embodiments, in any combination(s) thereof:

- A method of producing heavy oils from a reservoir by single well cross steam and gravity drainage (SW-XSAGD), comprising: providing a horizontal well below a surface of a reservoir; said horizontal well having a toe end and a heel end; injecting steam into a plurality of injection points between said toe end and said heel end; and said injection points surrounded by production segments completed with passive flow control devices (FCDs); wherein said method produces more oil at a time point than a similar SW-SAGD well with steam injection only at said toe or a similar cross steam and gravity drainage (XSAGD) well.
- A method or well configuration as herein described wherein each injection point is separated from a production segment by at least two thermal packers.
- A method as herein described wherein production and injection take place simultaneously.
- A method as herein described wherein injected steam includes solvent.
- A method as herein described wherein said method includes a preheating phase wherein steam is injected along the entire length of the well.
- A method as herein described wherein said method includes a cyclic preheating phase comprising a steam injection period along the entire length of the well followed by a soaking period.
- A method as herein described method of claim 6, including three cyclic preheating phases.
- A method as herein described wherein said method includes a pre-heating phase comprising a steam injection in both the injection segments and the production segments, followed by a soaking period.
- A method as herein described three, four or more cyclic pre-heating phases.
- A method as herein described wherein said soaking period is 10-30 days or about 20 days.
- A method or well configuration as herein described wherein there is an array of SW-XSAGD wells.
- A method or well configuration as herein described wherein there is an array of SW-XSAGD wells and alternating wells have injector segments arranged so that said injector wells are staggered in an adjacent well.
- A well configuration for producing heavy oils from a reservoir SW-XSAGD, comprising: a horizontal well below a surface of a reservoir; said horizontal well having a toe end and a heel end and having a plurality of production segments alternating with a plurality of injecting segments; one or more packers between each injection segment and each production segment; each production segment completed with passive FCDs; and said injection segment fitted for steam injection.
- A method or well configuration as herein described wherein a plurality of parallel horizontal wells originate from a single wellpad or a plurality of well pads, and where steam injection points on adjacent wells align.
- A method or well configuration as herein described wherein a plurality of parallel horizontal wells originate from a single wellpad or a plurality of wellpads, and where steam injection points on adjacent wells are staggered.
- A method or well configuration as herein described wherein the injection segments are 1-50 meters or 1-20 m or 1-2 m in length and the production segments are 50-500 or 100-300 meters or 150-200 m in length.
- A method or well configuration as herein described wherein adjacent wells are 50-200 meters apart or 75-150 meters apart.

"SW-SAGD" as used herein means that a single well serves both injection and production purposes, but nonetheless there may be an array of SW-SAGD wells to effectively cover a given reservoir. This is in contrast to conventional SAGD wherein dual injection and production wells are separate during production phase, necessitating a wellpair at each location.

"Cross SAGD" or "XSAGD" refers in its original sense to well completions using perpendicular injectors and producers. However, herein the "SW-XSAGD" uses multiple injection points in a SW-SAGD completion, thus simulating the crossing steam chambers of XSAGD.

As used herein, "preheat" and "startup" are used in a manner consistent with the art. In SAGD the preheat or startup phase usually means steam injection throughout both wells until the steam chamber is well developed and the two wells are in fluid communication. In SW-XSAGD it means steam injection throughout in order to improve injectivity and begin development of a steam chamber along the length of the well.

As used herein, "cyclic preheat" is used in a manner consistent with the art, wherein the steam is injected, preferably throughout the horizontal length well, and left to soak for a period of time, and typically any produced oil collected. Typically the process is then repeated two or more times.

Steam injection throughout the length of the well can be achieved herein by merely removing or opening packers, such that steam travels the length of the well, exiting any slots or perforations used for production.

After an optional preheat or cyclic preheat startup phase, the well is used for production, and steam injection occurs only at the injection points designated hereunder, with packers and with optional blank pipe separating injection section(s) from production sections.

With the FCD use in the production segment, it may be possible to eliminate or reduce blank pipe sections between injector segments and producer segments, thus avoiding the oil loss that typically occurs behind blank pipe sections in SW-SAGD.

Alternatively, a blank pipe can be slotted only in the middle section, the ends left blank, and thus a single joint provides an injector section thus shortening the overall injection segment and blank pipe length. In such an embodiment, the outer thirds or outer quarters can be left blank, and the central portion therebetween be slotted or perforated at an appropriate density for an injector segment. Indeed, the injector section can be as sort as a meter or two, leaving 10-20 feet of blank on either side, depending on joint length.

Injection sections need not be large herein, and can be on the order of <1-50 m, or 20-40 m, or about one or two joint lengths. The production segments are typically longer, e.g., 100-300 m or 150 to 200 m each. Adjacent horizontal wells in an array can be 50-200 meters apart, preferably about 75-150, and preferably originate from the same wellpad, reducing surface needs. Additional modeling will be needed to optimize these lengths for a given reservoir, but these lengths are expected to be typical.

The ideal length of blank pipe will vary according to reservoir characteristics, oil viscosity as well as injection pressures and temperatures, but a suitable length is in the order of 10-40 feet or 20-30 feet of blank liner. However, it is predicted that in many cases the FCDs will least reduce if not eliminate the use of blank liner.

A suitable arrangement, might thus be a 150-200 meter long production passage, 10-40 meter blind interval, packer, 1-20 meter long injection passage followed by another packer, 10-40 meter blind interval and 150-200 meter production passage, and this arrangement can repeat 2-3 times, or as many times as needed for the well length. The toe end of the well is finished with either an injection segment or a production segment.

By "heel end" herein we include the first joint in the horizontal section of the well, or the first two joints.

By "toe end" herein we include the last joint in the horizontal section of the well, or the last two joints.

By "between the toe end and the heel end", we mean an injection point that lies outside of the first or last joint or two of the ends of the horizontal portion of the well.

As used herein, flow control device "FCD" refers to all variants of tools intended to passively control flow into or out of wellbores by choking flow (e.g., creating a pressure drop). The FCD includes both inflow control devices "ICDs" when used in producers and outflow control devices "OCDs" when used in injectors. The restriction can be in form of channels or nozzles/orifices or tortuous pathways, or combinations thereof, but in any case the ability of an FCD to equalize the inflow along the well length is due to the difference in the physical laws governing fluid flow in the reservoir and through the FCD. By restraining, or normalizing, flow through high-rate sections, FCDs create higher drawdown pressures and thus higher flow rates along the bore-hole sections that are more resistant to flow. This corrects uneven flow caused by the heel-toe effect and heterogeneous permeability.

Suitable FCDs include the Equalizer™ and Equalizer Select™ from Baker Hughes®, the FlowReg™ or MazeGlo FlowReg™ from Weatherford®, the Resinject™ from Schlumberger®, and the like.

By "providing" a well, we mean to drill a well or use an existing well. The term does not necessarily imply contemporaneous drilling because an existing well can be retrofitted for use, or used as is.

By being "fitted" or "completed" for injection or production what we mean is that the completion has everything is needs in terms of equipment needed for injection or production.

"Vertical" drilling is the traditional type of drilling in oil and gas drilling industry, and includes any well <45° of vertical.

"Horizontal" drilling is the same as vertical drilling until the "kickoff point" which is located just above the target oil or gas reservoir (pay-zone), from that point deviating the drilling direction from the vertical to horizontal. By "horizontal" what is included is an angle within 45° (≤45°) of horizontal. Of course every horizontal well has a vertical portion to reach the surface, but this is conventional, understood, and typically not discussed. Furthermore, even horizontal wells undulate to accommodate undulations in the play or as imperfections in drilling pathway.

A "perforated liner" or "perforated pipe" is a pipe having a plurality of entry-exits holes throughout for the exit of steam and entry of hydrocarbon. The perforations may be round or long and narrow, as in a "slotted liner," or any other shape. Perforated liner is typically used in a production segment.

A "blank pipe" or "blank liner" or "blind pipe" is a joint that lacks any holes. These are typically used to separate injection and production segments and to bracket FCDs.

A "blank joint with central perforated injector section" refers to a blank pipe that is slotted or perforated only within the central portion of the pipe, thus leaving about 25-40% of each end of the pipe blank. Such pipes would need to be custom manufactured, as perforated pipes are typically perforated almost to the ends, leaving only the couplings (buttress threads) solid plus one to 12 inches for strength.

A "packer" refers to a downhole device used in almost every completion to isolate the annulus from the production conduit, enabling controlled production, injection or treatment. A typical packer assembly incorporates a means of securing the packer against the casing or liner wall, such as a slip arrangement, and a means of creating a reliable hydraulic seal to isolate the annulus, typically by means of an expandable elastomeric element. Packers are classified by application, setting method and possible retrievability.

A "joint" is a single section of pipe.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| bbl | Oil barrel, bbls is plural |
| CSOR | Cumulative Steam to oil ratio |
| CSS | Cyclic steam stimulation |
| ES-SAGD | Expanding Solvent-SAGD |
| FCD | Flow Control Device |
| ICCT | Insulated Concentric Coiled Tubing |
| OOIP | Original Oil in Place |
| SAGD | Steam Assisted Gravity Drainage, |
| SD | Steam drive |
| SOR | Steam to oil ratio |
| SW-SAGD | Single well SAGD |
| SW-XSAGD | Single well cross SAGD |
| XSAGD | Cross SAGD |

BRIEF DESCRIPTION OF THE SEVERAL VIEWS OF THE DRAWINGS

FIG. 3B has a greatly exaggerated vertical scale relative to the lateral dimensions. Plugging lengthens the steam pathway, reducing flashing. From Stalder (2007).

FIG. 4A shows SW-XSAGD wherein an array of SW-SAGD are provided with multiple injection points, and steam control is achieved with FCD completions as an aligned layout, where the injection points are aligned, whereas

DETAILED DESCRIPTION OF THE INVENTION

The present disclosure provides a novel well configurations and methods for single well SAGD that mimics cross SAGD in effect. The implementation requires SW-SAGD with multiple equally spaced injection points along the well, and FCD completions in the production segments for steam trap control. The SW-SAGD wells can be multiplied to provide an array of wells that covers a given play.

Example 1: SW-XSAGD

The new concept of SW-XSAGD disclosed herein a novel method to achieve both SW-SAGD and XSAGD.

In this well configuration, we place multiple injection points along together with flow control devices or FCDs within the production segments of a single horizontal well to replace the crossing wells in the original XSAGD and achieve the similar steam chamber development as in the original XSAGD. Of course, arrays of SW-XSAGD wells can be used to cover a larger play, but the idea can be tested in a single well layout as described.

Figure 1A:
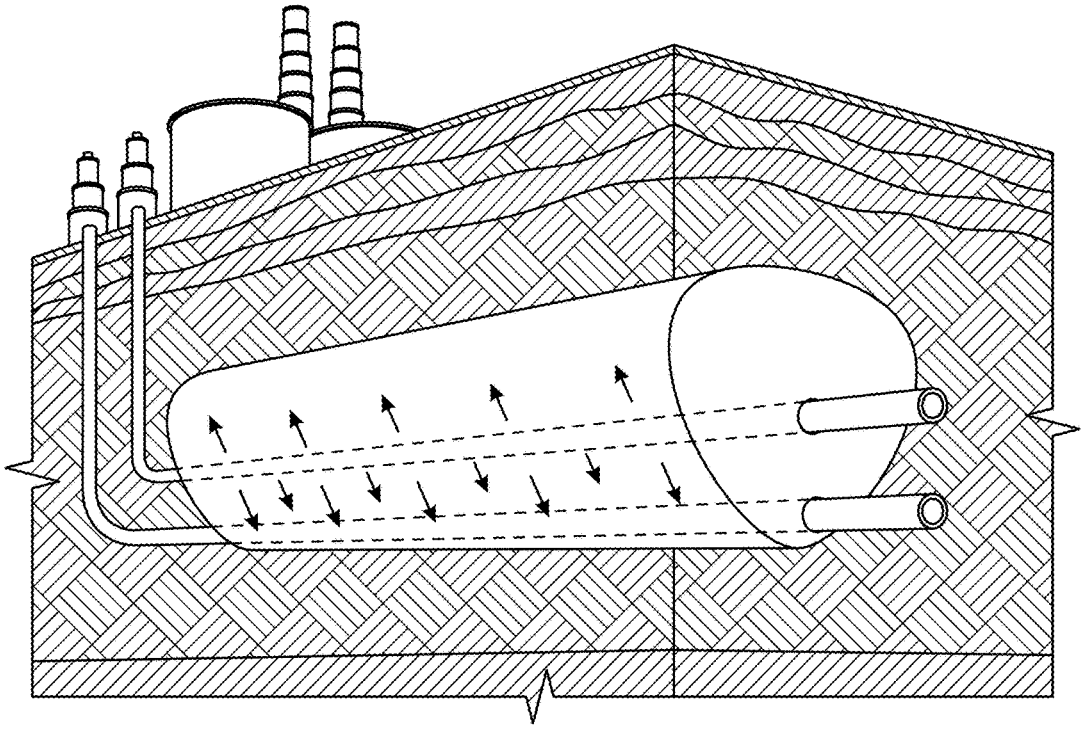
FIG. 1A (Prior Art)
FIG. 1A shows traditional SAGD wellpair, with an injector well a few meters above a producer well in a transverse view showing the vertical and horizontal portions of the well pair.
Figure 1B:
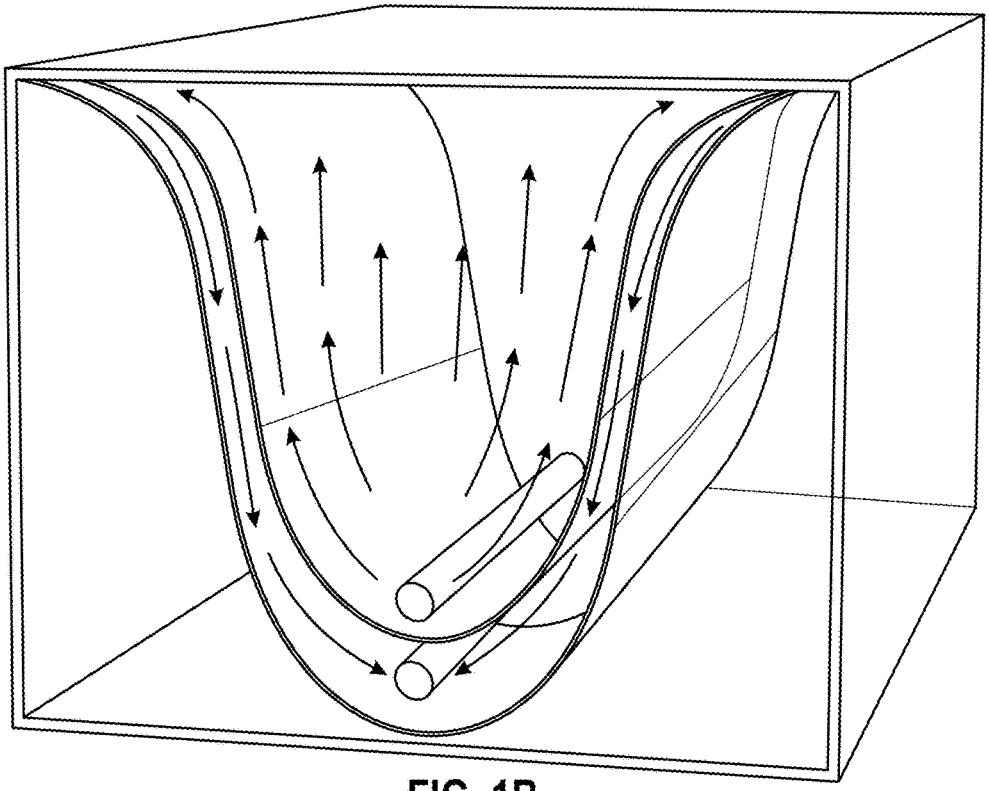
FIG. 1B (Prior Art)
FIG. 1B shows a cross-section of a typical steam chamber.
Figure 2A:
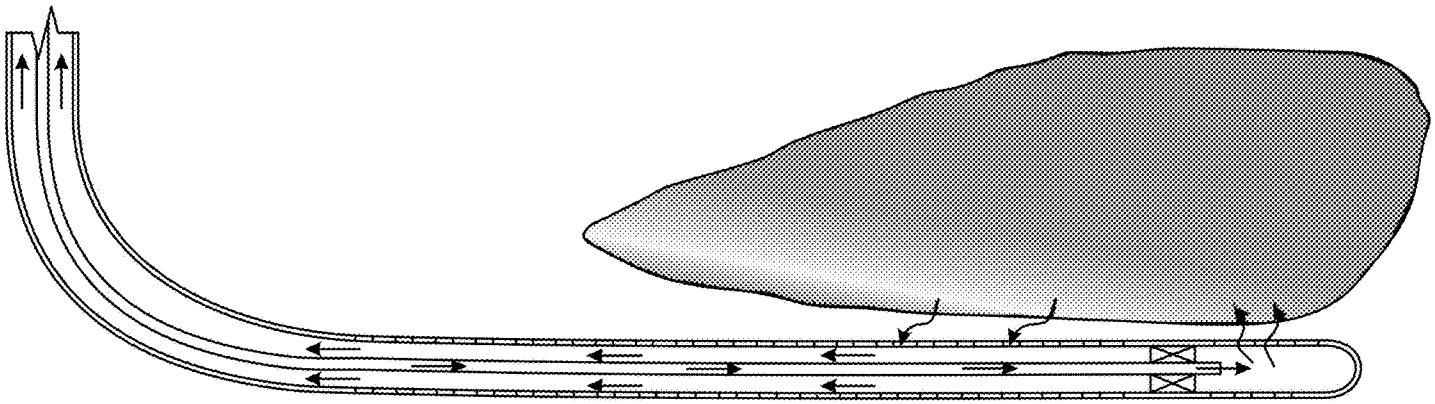
FIG. 2A (Prior Art)
FIG. 2A shows a SW-SAGD well, wherein the same well functions for both steam injection and oil production as steam is injected into the toe (in this case the toe is updip of the heel), and the steam chamber grows towards the heel. Steam control is via packer.
Figure 2B:
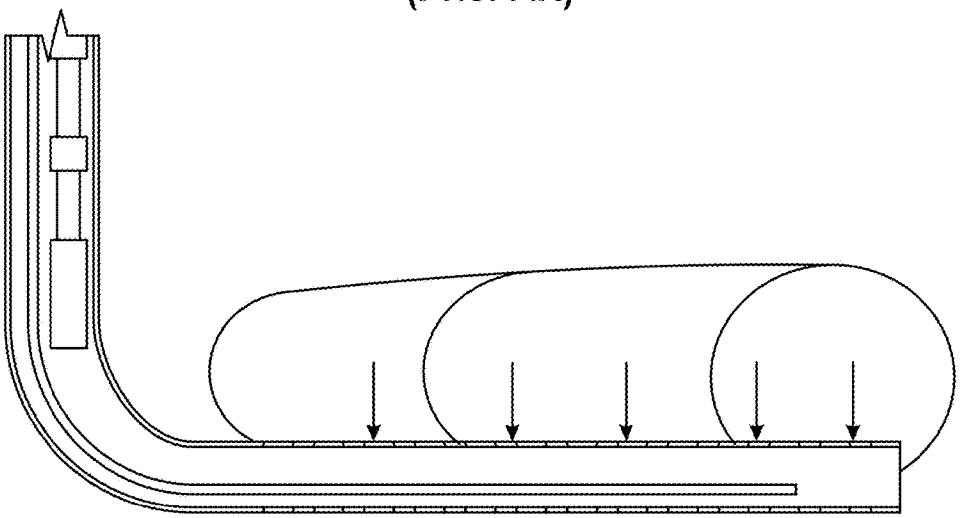
FIG. 2B (Prior Art)
FIG. 2B shows another SW-SAGD well configuration wherein steam is injected via ICCT, and a second tubing is provided for hydrocarbon removal.
Figure 3A:
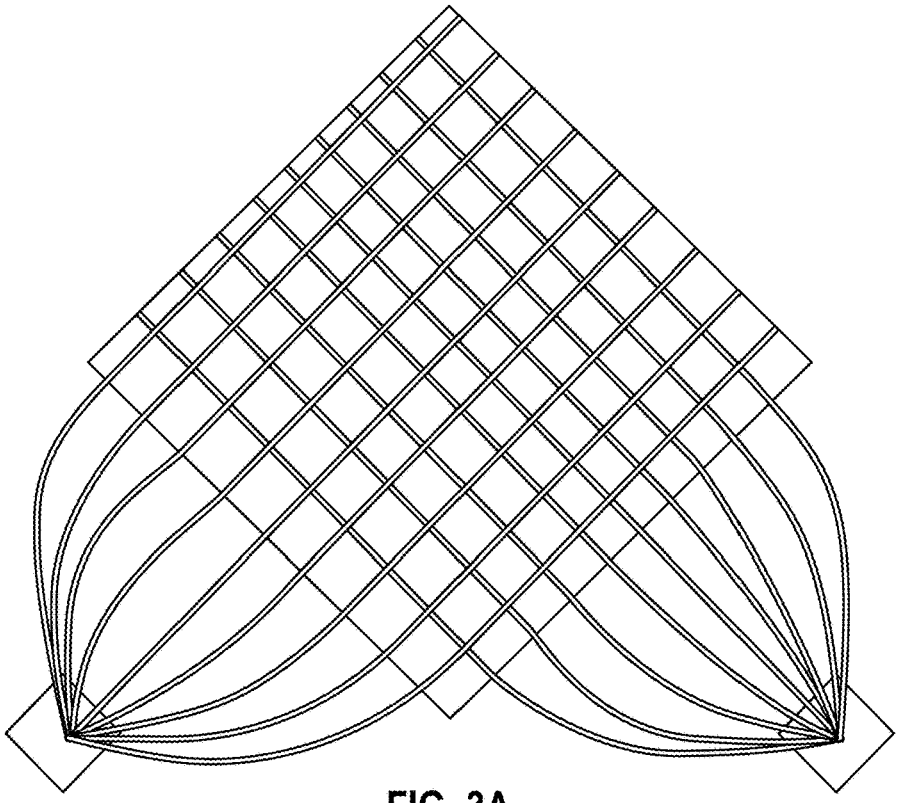
FIG. 3A (Prior Art)
FIG. 3A shows a cross SAGD layout from a top plan view.
Figure 3B:
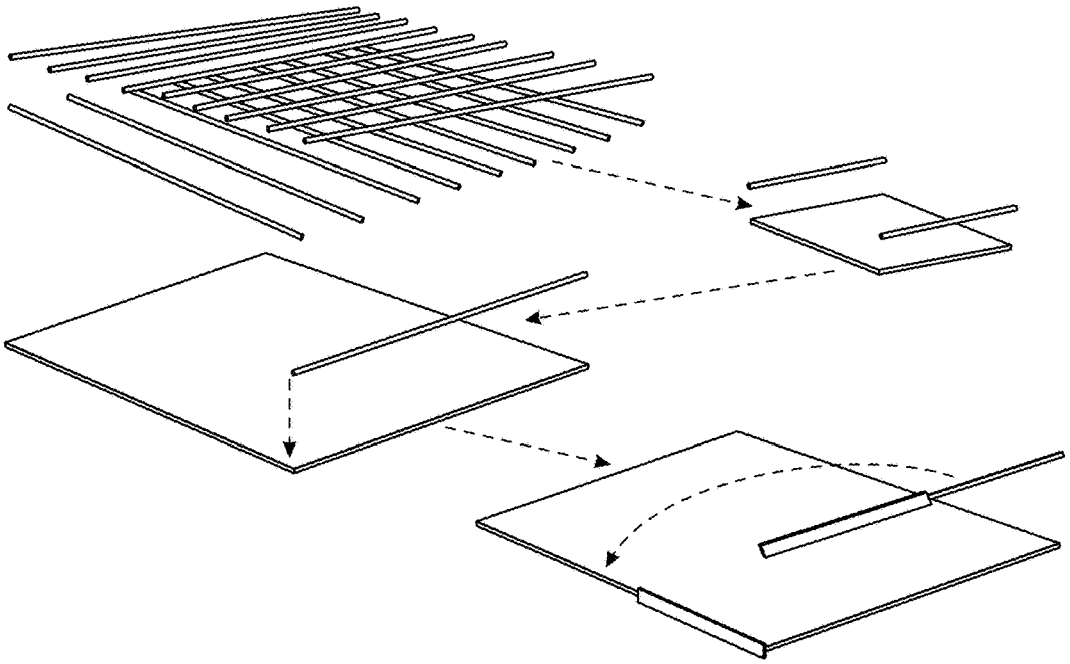
FIG. 3B (Prior Art)
FIG. 3B shows a perspective view before and after plugging for steam trap control. Symmetry element representing 1/256 of an 800-m square "half pad" with producers and injectors on 100-m spacing. Reservoir thickness is not shown. The shaded element is 50×50 m in the plane of the producers.
Figure 4A:
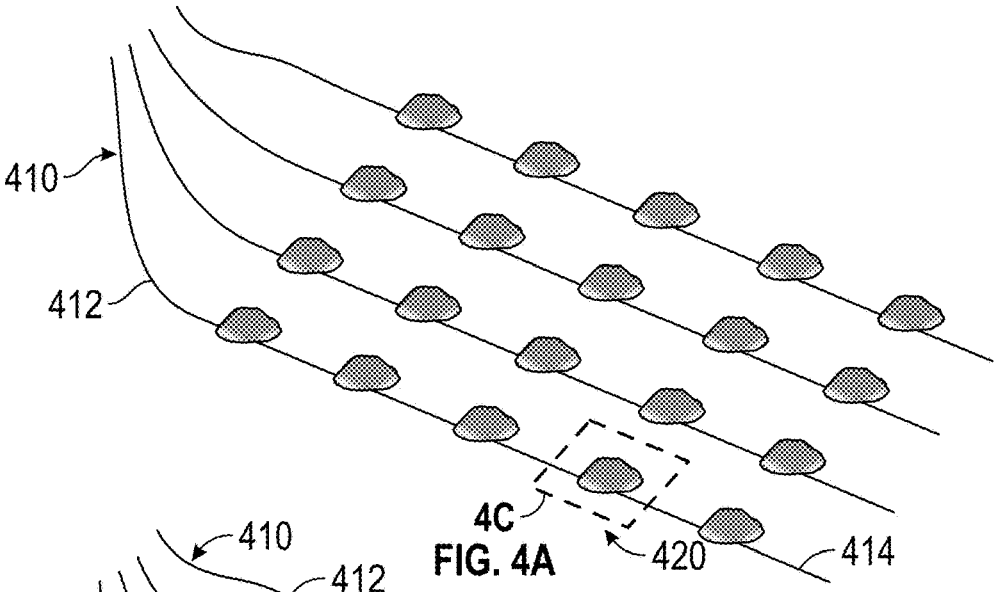
Figure 4B:
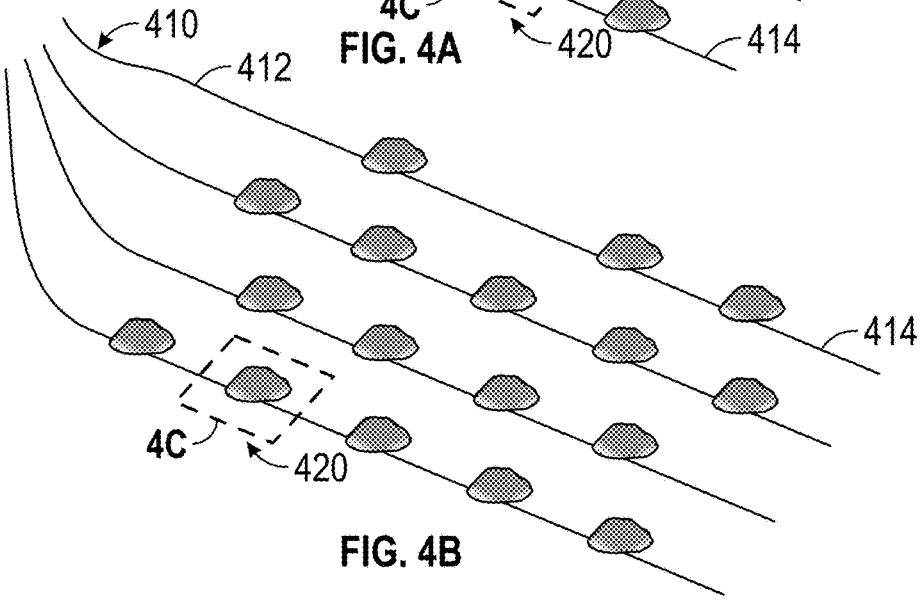
FIG. 4B is a staggered layout, both shown in top view.
Figure 4C:
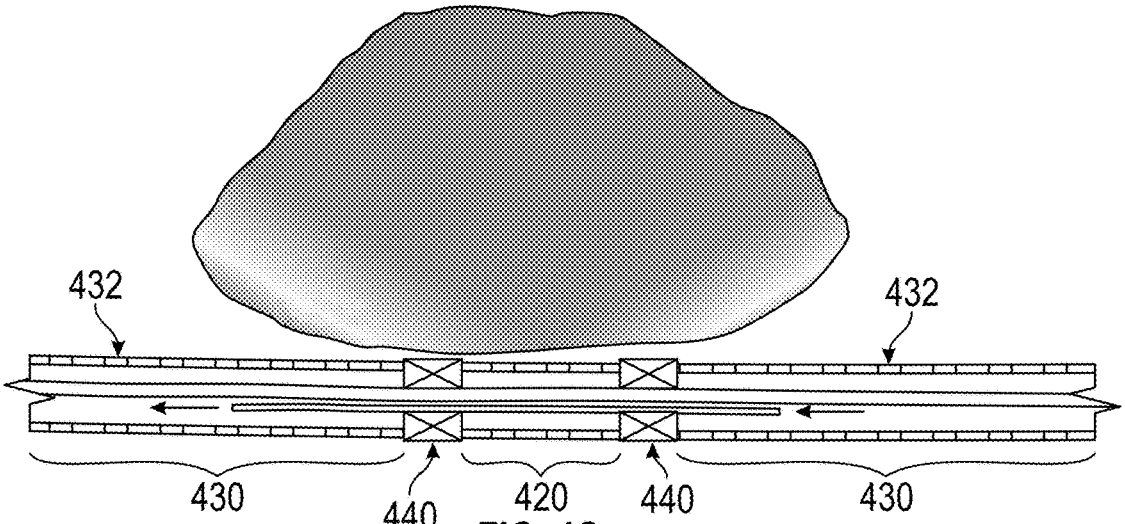
FIG. 4C is a 2D (vertical cross section along the well's longitudinal axis) view of individual steam chamber development.

In contrast to the XSAGD configuration in FIG. 3, FIG. 4 gives a schematic of SW-XSAGD array. In SW-XSAGD arrays, multiple horizontal wells 410 are drilled from the wellpad and placed close to the bottom of the pay zone. The heel of the well 412 is located below the wellpad and the toe 414 is located at the end of the well. Those horizontal wells are roughly parallel to each other, with lateral spacing similar to SAGD well pairs, i.e., 50 m to 150 m. Note that, unlike SAGD or XSAGD, there is no need of any upper injectors, and thus the well count (and costs) are halved!

The horizontal wells are completed with multiple steam injection segments 420 (e.g., 1 to 50 m each) and production segments 430 (e.g., 150 to 200 m each) that are alternated and evenly distributed along the wells.

Thermal packers 440 are required to separate the injection 420 and production 430 segments within the same wells. For the production segments 430, passive FCDs 432 are installed to actively control steam/gas break-through.

If relatively short injector segments 420 are used, it may be possible to avoid FCD use in the injector segments because the injection segments are relatively short and the steam injection profiles are not as critical as for the 1000 m long injectors in conventional SAGD.

FIGS. 4A and 4B show two arrangements of injection/production between adjacent wells, FIG. 4A with aligned layout and FIG. 4B with staggered layout.

The operation of SW-XSAGD is straightforward. Depending upon the reservoir initial conditions, the single-well XSAGD process can start directly with steam injection if there is initial injectivity, or with a preheating period or even cyclic preheat with soaks. Depending on the spacing of the wells, initial temperatures, permeability, steam temperature and pressure, it is expected that the preheat period may also be substantially shortened.

After startup, steam is continuously injected through the injection segments 420 in each well and multiple steam chambers form simultaneously along each well, each growing outwards towards the next steam chamber and over the producer segment 430. Just like in the SAGD, the oil surrounding the steam chambers is heated up and drains towards to the production segments 430 under gravity when it becomes mobile.

The FCDs 432 installed within the production segments 430 become important when the steam chambers develop over the production segments 430. Without the FCDs, the liquid production rate has to be constrained to avoid live steam production, but with FCDs in place, the steam/gas breakthrough automatically results in large pressure drop across the wellbore, thereby causing block of gas production locally and allowing higher liquid withdraw rate through the rest of production segment 430 and better thermal efficiency.

The FCDs function similar to the manual plug control in the original XSAGD, both of which allow managing the distance between the injection and production points through the life of the process.

During the late stage of the operation, the steam chambers are fully mature with oil depleted from most of the reservoir, but some oil left may be behind to the extent there are wedges between chambers, although we expect less oil left behind the wedges in the staggered layout and in those layouts with short (1-2 m) injector sections and/or short blank pipes. However, even if improved, some oil typically does remain in place.

The process can then be converted into steam flood or steam drive by converting alternating wells into pure injectors and pure producers, respectively, targeting the wedge oil zones, until the economic limit is reached.

During the late stage with mature steam chambers, about half of the wells are converted into injection-only wells by shutting in their production segments and the other half are converted into production-only wells by stopping steam injection and opening the entire length to production. The injection-only wells and production-only wells are arranged in an alternating fashion such that the injection-only wells are sandwiched by production-only wells. Steam is then continuously injected via injection-only wells to drive oil remained in any wedges towards to the production wells.

Example 2: Completions

Casing joints are typically 47 ft (14.3 m) long, so there are 7 joints in 100 m. In our first test of FCDs use, the injection FCD was only about 1 m long (having only 6 in of screen), spaced at roughly 5 injector FCDs per 100 m of injector liner. These were set up as FCD-FCD-blank-FCD-FCD-blank-etc. However, we anticipate using much shorter injector sections herein, even as short as a meter.

The production FCD was about 8 m long (with 17 ft of screen ~5 m), spaced at 7 producer FCDs per 100 m of producer liner, that is, an FCD on every joint.

Figure 5:
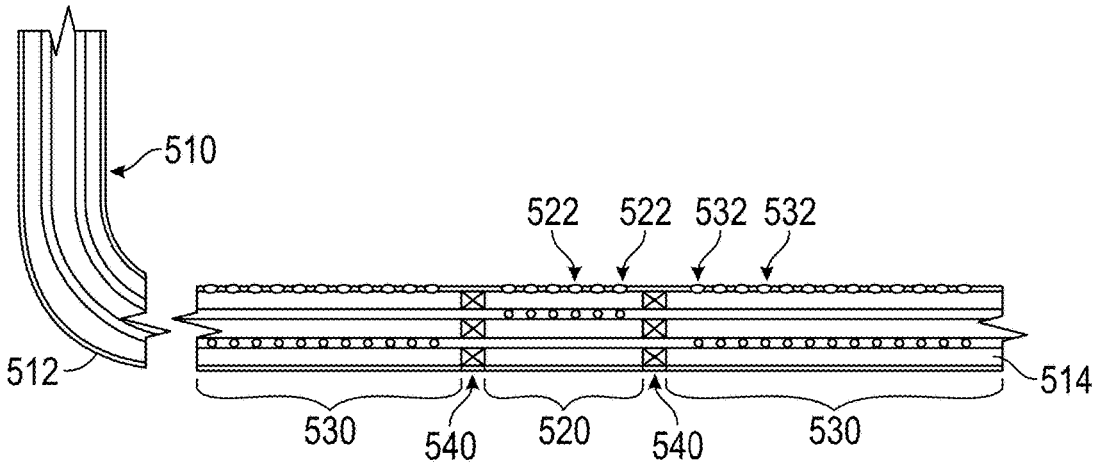
FIG. 5 shows one possible completion plan, whereby a full tubing completion option is shown.
Figure 6:
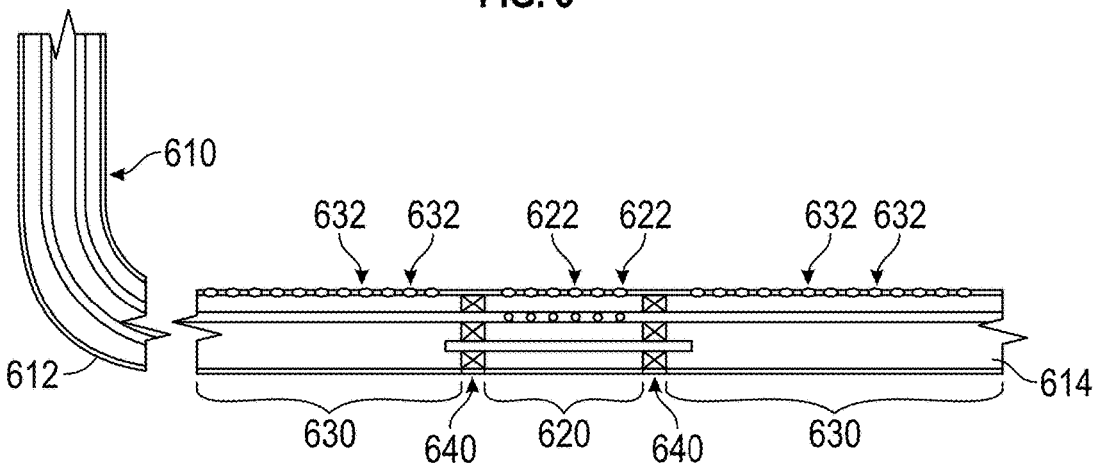
FIG. 6 shows another completion that includes bridge tubing.
Figure 7:
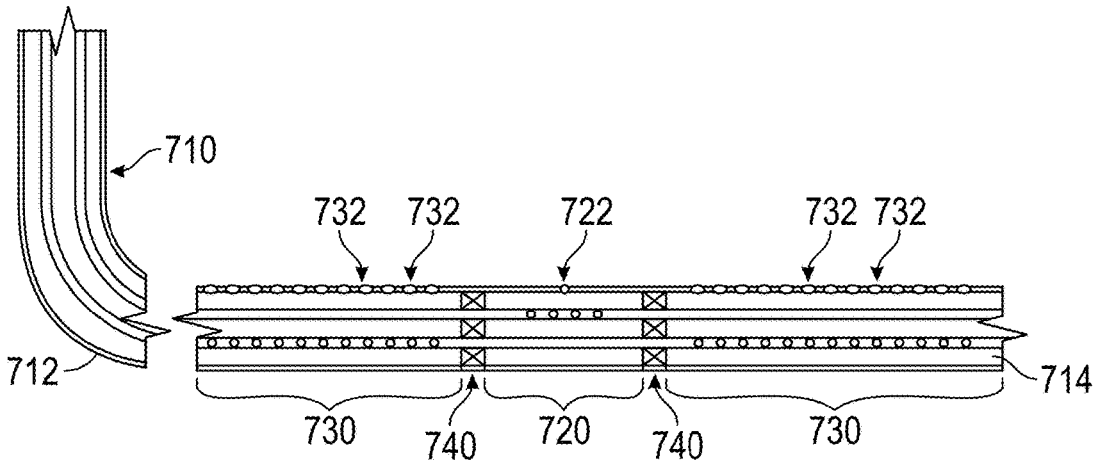
FIG. 7 shows another completion with blank pipe having one or more central slots instead of FCDS in the injector segment.

FIG. 5-7 (not drawn to scale) show additional completion options, wherein only a single bracketed injector section is shown, but these alternating section can be repeated as many times as needed to cover the length of the well. Typically the heel 512, 612, or 712 will be a producer section, but this is not essential. The toe 514, 614, 714 can be either.

FIG. 5 shows injector tubing that is perforated in injector sections 520 and separated from production sections 530 by blank pipe and packers 540. The producer tubing is of course only perforated in the production sections 520 and also separated by blank pipe and packers 540. This particular completion shows FCDs 522 & 532 in the outer pipe of both injector 520 and producer 530 segments, although it may be possible to greatly reduce FCD 522 use in the injector section 520. The FCDs typically are equipped with sand screens at the intakes.

FIG. 6 shows a bridge tubing completion approach, where the horizontal well 610 has a short piece of bridge tubing which allows produced oil to travel the length of the pipe from one producer section 630 to the next, and past the otherwise separated injector section The horizontal wells 610 are completed with multiple steam injection segments 620 (e.g., 1 to 50 m each) and production segments 630 (e.g., 150 to 200 m each) that are alternated and evenly distributed along the wells. 620. Production FCDs 632 are located in open producing sections 630 of the horizontal well 610, separated by thermal packers 640 from the injection sections 620 containing optional injection FCDs 622. These sections repeat from the heel 612 to the toe 614 of the horizontal well 610.

FIG. 7 shows yet another option, wherein the injector section 720 is not completed with FCDs at all, but merely has a blank pipe section with central perforated section 722. The completion of FIG. 7 can also be done in a bridge tubing approach, per FIG. 6. The horizontal wells 710 are completed with multiple steam injection segments 720 (e.g., 1 to 50 m each) and production segments 730 (e.g., 150 to 200 m each) that are alternated and evenly distributed along the wells. Production FCDs 732 are located in producing sections 730 of the horizontal well 710, separated by thermal packers 740 from the injection sections 720 containing an injection port 722 which may optionally contain one or more FCDs. These sections repeat from the heel 712 to the toe 714 of the horizontal well 710.

Figure 8:
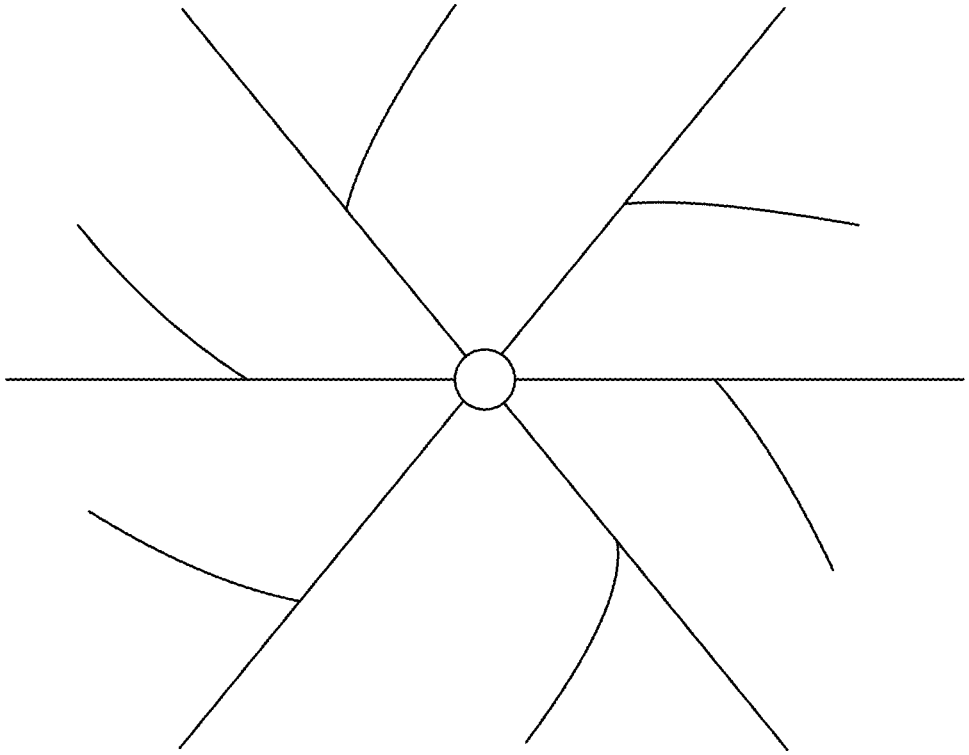
FIG. 8 shows atop view of radial wells.
Figure 9:
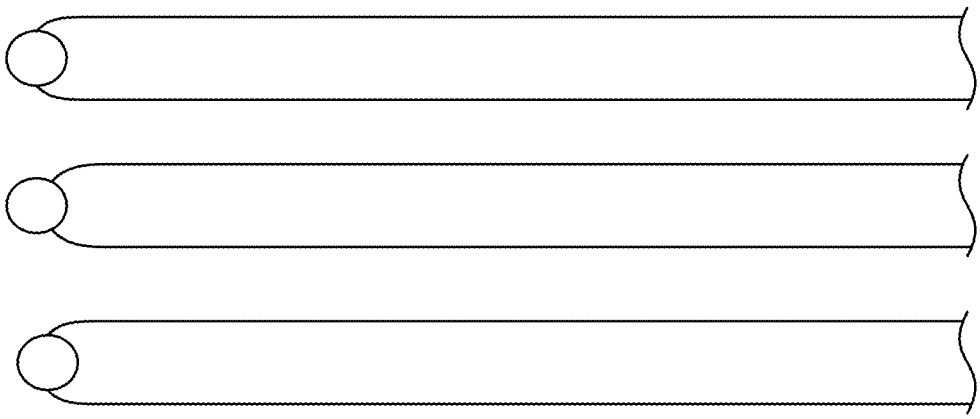
FIG. 9 shows a top view of an array of parallel wells. Of course real wells may only be roughly parallel as their track may meander more or less due to reservoir features and/or imperfect drilling.

FIGS. 8 and 9 show various top views illustrating a radial arrangement of wells with a lateral (FIG. 8), and an array of parallel wells, two or more of which can originate from a single wellpad (FIG. 9) providing the vertical well deviates at or near the bottom of the well to the desired track.

Example 3: Steam Chamber Simulations

To evaluate the performance of the proposed modification to the conventional SW-SAGD and XSAGD, numerical simulation with a 3D homogeneous model is conducted using Computer Modeling Group® Thermal & Advanced Processes Reservoir Simulator, abbreviated CMG-STARS. CMG-STARS is the industry standard in thermal and advanced processes reservoir simulation. It is a thermal, k-value (KV) compositional, chemical reaction and geomechanics reservoir simulator ideally suited for advanced modeling of recovery processes involving the injection of steam, solvents, air and chemicals.

The reservoir simulation model is provided the average reservoir properties of Athabasca oil sand (e.g., Surmont), with an 800 m long horizontal well placed at the bottom of a 20 m pay. The simulation considers four cases, the conventional SW-SAGD, conventional XSAGD, and a four well array of SW-XSAGD with 4 injectors equally spaced into configurations, one with aligned injectors, and the other with staggered injectors.

Although not yet run, it is predicted that a more uniform steam chamber will be produced in this method, and that the steam chambers will cover the length of the well much more quickly than in SW-SAGD, and at greatly reduced cost over X-SAGD. Further, we expect the staggered injectors to be better than aligned injectors.

Example 4: Production Simulations

In order to improve the operation of the SW-XSAGD production simulations, also using CMG-STARS, should be performed. Data will of course vary by reservoir, but we use typical Surmont operation parameters as an example.

The oil production rate is predicted to be improved, although the simulations have not yet been run. The oil recovery factor is also predicted to improve, which would illustrate significant benefit of the described invention over the conventional SW-SAGD and over conventional XSAGD. Further, we expect the staggered injectors to produce more OOIP and leave less wedge oil behind.

The following references are incorporated by reference in their entirety for all purposes.

1. U.S. Pat. No. 5,626,193, "Method for recovering heavy oil from reservoirs in thin formations."
2. U.S. Pat. No. 8,240,381, "Draining a Reservoir with an Interbedded Layer."
3. U.S. Pat. No. 8,528,638, "Single Well Dual/Multiple Horizontal Fracture Stimulation for Oil Production."
4. U.S. Pat. No. 8,528,639, "Method for Accelerating Start-Up for Steam-Assisted Gravity Drainage (SAGD) Operations."
5. U.S. Pat. No. 8,607,866, "A Method for Accelerating Start-Up for Steam Assisted Gravity Drainage Operations."
6. U.S. Pat. No. 8,607,867, "Oil Recovery Process."
7. U.S. Pat. No. 8,967,282, "Enhanced Bitumen Recovery Using High Permeability Pathways."
8. US20100326656, "Pattern Steamflooding with Horizontal Wells."
9. US20120043081, "Single Well Steam Assisted Gravity Drainage."
10. US20120247760, "Dual Injection Points in SAGD."
11. US20120273195, "Method for Steam Assisted Gravity Drainage with Pressure Differential Injection."
12. US20130180712, "Method for Accelerating Heavy Oil Production."
13. US20130213652, "SAGD Steam Trap Control."
14. US20130213653, "Toe Connector Between Producer and Injector Wells."
15. US20130333885, "Lateral Wellbore Configurations with Interbedded Layer."
16. US20140000888, "Uplifted Single Well Steam Assisted Gravity Drainage System and Process."
17. US20140345861, "Fishbone SAGD."
18. US20140345855, "Radial Fishbone SAGD."
19. Falk, K., et al., "Concentric CT for Single-Well Steam Assisted Gravity Drainage," World Oil, July 1996, pp. 85-95.
20. McCormack, M., et al., Review of Single-Well SAGD Field Operating Experience, Canadian Petroleum Society Publication, No. 97-191, 1997.
21. Moreira R. D. R., et al., IMPROVING SW-SAGD (SINGLE WELL STEAM ASSISTED GRAVITY DRAINAGE), Proceedings of COBEM 2007 19th International Congress of Mechanical Engineering, available online at http://www.abcm.org.br/pt/wp-content/anais/cobem/2007/pdf/COBEM2007-0646.pdf.
22. Faculdade de Engenharia Mecânica, Universidade estadual de Campinas. Sã
23. SPE-59333 (2000) Ashok K. et al., A Mechanistic Study of Single Well Steam Assisted Gravity Drainage.
24. SPE-97647-PA (2007) Stalder, J. L., Cross SAGD (XSAGD)—an accelerated bitumen recovery alternative, SPE Reservoir Evaluation & Engineering 10(1), 12-18.
25. SPE-54618 (1999) Elliot, K., Simulation of early-time response of singlewell steam assisted gravity drainage (SW-SAGD).
26. SPE-153706 (2012) Stalder, Test of SAGD Flow Distribution Control Liner System, Surmont Field, Alberta, Canada.

The invention claimed is:

1. A single well cross steam assisted gravity drainage (SW-SGAD) well configuration for producing heavy oils from a reservoir, comprising:

a) an array of horizontal SW-SAGD wells near a bottom of a payzone in a heavy oil reservoir;

b) each SW-SAGD well having an outer casing inside of which is an injection tubing beside a production tubing;

c) each SW-SAGD well having a plurality of injection segments and a plurality of production segments between a toe end and a heel end of said SW-SAGD well, each injection segment alternating with a production segment, and each said injection segment fitted for steam injection and each production segment fitted for oil production;

d) one or more packers between each injection segment and each production segment to isolate steam injection from oil production;

e) each production segment comprising a plurality of passive flow control devices (FCDs) on said outer casing;

f) each production tubing being blank in each injection segment such that produced oil can bypass said injection segment and being perforated, slotted or absent in each production segment.

2. The SW-SAGD well configuration of claim 1, wherein a plurality of roughly parallel horizontal SW-SAGD wells originate from a single wellpad or a plurality of well pads, and where steam injection points on adjacent SW-SAGD wells align.

3. The SW-SAGD well configuration of claim 1, wherein a plurality of roughly parallel horizontal SW-SAGD wells originate from a single wellpad, and where steam injection segments on adjacent SW-SAGD wells are staggered.

4. A method of producing heavy oil, comprising providing the SW-SAGD well configuration of claim 3 in a heavy oil reservoir, injecting steam into each of said injection segments and simultaneously producing heavy oil in each of said production segments.

5. The SW-SAGD well configuration of claim 1, wherein the injection segments are 1-20 meters in length and production segments are 150-200 meters in length.

6. The SW-SAGD well configuration of claim 5, wherein adjacent SW-SAGD wells in said array are 50-200 meters apart.

7. The SW-SAGD well configuration of claim 1, wherein adjacent SW-SAGD wells are 75-150 meters apart.

8. The SW-SAGD well configuration of claim 1, wherein the injection segments are 1-50 meters in length and the production segments are 100-300 meters in length, and the blank tubing is 10-40 meters in length and adjacent SW-SAGD wells are 50-200 meters apart.

9. A method of producing heavy oil, comprising providing the SW-SAGD well configuration of claim 8 in a heavy oil reservoir, injecting steam into each of said injection segments and simultaneously producing heavy oil in each of said production segments.

10. The SW-SAGD well configuration of claim 1, wherein the injection segments are 1-20 meters in length and the production segments are 150-200 meters in length, the blank tubing is 10-20 meters in length and adjacent SW-SAGD wells are 75-150 meters apart.

11. A method of producing heavy oil, comprising providing the SW-SAGD well configuration of claim 10 in a heavy oil reservoir, injecting steam into each of said injection segments and simultaneously producing heavy oil in each of said production segments.

12. A method of producing heavy oil, comprising providing the SW-SAGD well configuration of claim 1 in a heavy oil reservoir, injecting steam into each of said injection segments and simultaneously producing heavy oil in each of said production segments.

13. The method of claim 12, wherein injected steam includes solvent for solvating said heavy oil.

14. The method of claim 12, wherein said method includes a preheating phase wherein steam is injected along an entire length of each SW-SAGD well followed by a soaking period.

15. The method of claim 14, including three cyclic preheating phases.

16. The method of claim 14, wherein said soaking period is 10-30 days.

17. The method of claim 14, wherein said soaking period is 20 days.

* * * * *